US005999633A

United States Patent [19]

Imai

[11] Patent Number: 5,999,633

[45] Date of Patent: Dec. 7, 1999

[54] SPEAKER DAMPER

[75] Inventor: Toshihiko Imai, Yamagata-ken, Japan

[73] Assignees: Pioneer Electronic Corporation, Tokyo; Tohoku Pioneer Electronic Corporation, Tendo, both of Japan

[21] Appl. No.: 08/931,621

[22] Filed: Sep. 16, 1997

[30] Foreign Application Priority Data

Sep. 17, 1996 [JP] Japan ..... 8-266683

[51] Int. Cl.[6] ..... H04R 25/00

[52] U.S. Cl. ..... 381/403; 381/404

[58] Field of Search ..... 381/197, 192, 381/194, 202, 396, 403, 404, 405, 423, FOR 192, FOR 157, FOR 162; 29/594, 609.1; 181/157

[56] References Cited

U.S. PATENT DOCUMENTS 1,820,585 4/1931 Tolerton ..... 381/403
1,957,562 5/1934 Tolerton ..... 381/404

*Primary Examiner*—Huyen Le
*Attorney, Agent, or Firm*—Morgan, Lewis & Bockius LLP

[57] ABSTRACT

There is provided a speaker damper comprising: an inner frame for inserting and holding a voice coil bobbin; an outer frame to be fixed on to a speaker frame in a speaker unit; a plurality of flexibly movable supporting arms bridged across a space between the inner frame and the outer frame; a plurality of reinforcing members each bridged across a space between two flexibly movable supporting arms adjacent to the inner frame.

10 Claims, 1 Drawing Sheet

SPEAKER DAMPER

BACKGROUND OF THE INVENTION

The present invention relates to a speaker damper, in particular to a speaker damper for use in a loudspeaker unit having an elliptical or rectangular shape.

There has been known a dynamic cone speaker unit in which electric signals may be converted into acoustic signals so as to produce sounds. The dynamic cone speaker unit has a conical vibrating diaphragm, the center of which is integrally connected with a voice coil bobbin winded by a voice coil. When electric current of sound signals is flowing through the voice coil, the voice coil (located in a magnetic gap) will be driven in a predetermined direction, causing the voice coil bobbin and the vibrating diaphragm to vibrate integrally, hereby producing acoustic signals.

The voice coil bobbin secured at the center of the vibrating diaphragm is also supported by a damper. In operation, the voice coil bobbin is caused to vibrate in the above predetermined driving direction together with a circumferential edge member supporting the outer circumference of the vibrating diaphragm, but not liable to vibrate in a direction orthogonal to the above predetermined driving direction.

The damper is constructed and installed in such a manner that when the voice coil is driven along the magnetic gap, the voice coil will not come into contact with a pole piece or a yoke (which are used to form a magnetic circuit). Further, the damper also serves to keep the vibrating diaphragm and the voice coil bobbin in positions when the voice coil is not driven.

For this reason, the damper is required to have the same characteristics as the above edge member, to ensure a sufficient amplitude for the vibration of the diaphragm. As a result, such a damper should be made of a material having a suitable softness and made into a shape not liable to roll or move in a lateral direction.

In fact, there have been several kinds of speaker dampers such as a circular damper and a butterfly damper.

A circular damper is formed by impregnating a piece of circular cloth with a resin, heating the resin-impregnated cloth to dry the same, forming a plurality of corrugations which are concentric circles in the resin-coated cloth, followed by formation of a circular hole for holding a voice coil bobbin in the center of the damper.

A butterfly damper is made by punching a thin bakelite plate or a thin metal plate. Such a butterfly damper comprises an inner frame for holding a voice coil bobbin, a plurality of flexibly movable supporting arms connected with the inner frame, an outer frame connected with the flexibly movable supporting arms for supporting the damper on to a frame in a speaker unit.

However, if a speaker unit is to be installed in a motor vehicle or a thin type television set, such a speaker unit should also be thin in its total thickness.

One example of a thin type speaker unit is an elliptical speaker unit having an elliptical vibrating diaphragm. If a circular damper as described above is used in such a thin type speaker unit, the outer diameter of the circular damper is restricted by the size of an elliptical frame in its shorter axis direction. Consequently, it is difficult to obtain a sufficient compliance, resulting in a problem that it is impossible to ensure a low sound characteristic which is necessary for producing a desired lowest resonance frequency $f_o$ and desired vibration amplitude.

On the other hand, a butterfly damper may have an elliptical shape and a structure as shown in FIG. 2. As illustrated in FIG. 2, the butterfly damper has an outer frame 104 arranged in the longitudinal direction of an elliptical speaker unit. The butterfly damper has a circular inner frame 103 in the center thereof for holding a voice coil bobbin, a plurality of flexibly movable supporting arms 102 integrally formed with the circular inner frame 103 and the outer elliptical frame 104. The flexibly movable supporting arms 102 are all arranged in the longitudinal direction of the elliptical damper. In this manner, it is possible to ensure a desired lowest resonance frequency $f_o$ and desired vibration amplitude. However, since the flexible supporting arms 102 are caused to provide support action in the longitudinal direction to support the voice coil bobbin (not shown) held on the circular inner frame 103, it is difficult to ensure that the force supporting the voice coil bobbin is uniform surrounding the whole circumference of the bobbin. When the voice coil is driven, the voice coil bobbin and the vibrating diaphragm are liable to roll, resulting a problem that the voice coil undesirably gets into contact with a pole piece and/or a yoke (which are used to form a magnetic circuit), hence undesirably producing an abnormal sound and/or damaging the voice coil itself.

SUMMARY OF THE INVENTION

It is an object of the present invention to provide an improved speaker unit which has an elliptical vibrating diaphragm but ensures a sufficient compliance and is capable of supporting a voice coil bobbin and vibrating diaphragm in a more stabilized manner, so as to solve the above-mentioned problems peculiar to the above-mentioned prior arts.

According to the present invention, there is provided a speaker damper comprising: an inner frame for inserting and holding a voice coil bobbin; an outer frame to be fixed on to a speaker frame in a speaker unit; a plurality of flexibly movable supporting arms bridged across a space between the inner frame and the outer frame; a plurality of reinforcing members each bridged across a space between two flexibly movable supporting arms adjacent to the inner frame.

In one aspect of the present invention, each of the reinforcing members is bridged across a space between two flexibly movable supporting arms, adjacent to the inner frame, so as to cooperate with the flexibly movable supporting arms to reinforce the inner frame.

In another aspect of the present invention, the outer frame, the plurality of flexibly movable supporting arms, the inner frame, the reinforcing members are integrally formed with each other by means of injection molding.

In a further aspect of the present invention, the reinforcing members may be formed adjacent to the inner frame in such a manner that there is no any gap between the reinforcing members and the inner frame.

The above objects and features of the present invention will become more understood from the following description with reference to the accompanying drawings.

DETAILED DESCRIPTION OF THE PREFERRED EMBODIMENTS

Figure 1:
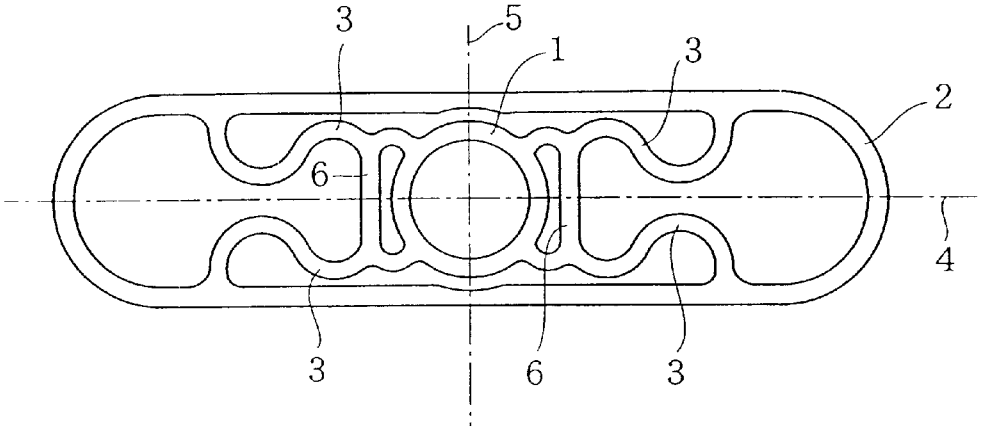
FIG. 1 is a plane view illustrating a speaker damper according to the present invention.
Figure 2:
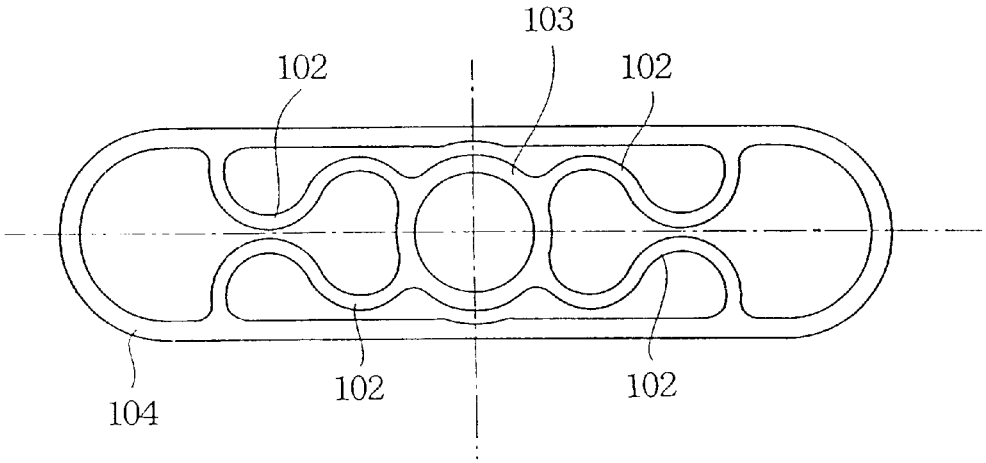
FIG.2 PRIOR ART
FIG. 2 is a plane view illustrating a speaker damper of prior art.

Referring to FIG. 1, the speaker damper of the present invention comprises an inner circular frame 1 for inserting and holding a voice coil bobbin (not shown), an outer elliptical frame 2 to be fixedly supported on a speaker frame of a speaker unit, a plurality of flexibly movable supporting arms 3 bridged between the inner frame 1 and the outer frame 2.

As shown in FIG. 1, the flexibly movable supporting arms 3 are each formed along a longer axis 4 of the elliptical damper. In fact, all the supporting arms 3 are arranged with the longer axis 4 and a shorter axis 5 as symmetrical axes, respectively.

Further, the speaker damper of the present invention includes a pair of reinforcing members 6 on either side of the inner frame 1. In detail, each reinforcing member 6 has a sufficient rigidity and is integrally connected with two flexibly movable supporting arms 3 which are arranged on both sides of the longer axis 4, with the longer axis 4 as the symmetrical axis.

The outer frame 2, the flexibly movable supporting arms 3, the inner frame 1, and the reinforcing members 6 are all formed into one plate, with the longer axis 4 and the shorter axis 5 as symmetrical axes, respectively. In practice, the speaker damper shown in FIG. 1 may be made of a resin by means of injection molding.

In the above-described structure, each flexibly movable supporting arm 3 includes one part connecting with the reinforcing member 6 and another part connecting with the outer frame 2, thus ensuring a compliance similar to that of a conventional butterfly damper. In this way, although the flexibly movable supporting arms 3 will be displaced in the bobbin driving direction for a same quantity as in a conventional speaker unit using a conventional butterfly damper, the flexibly movable supporting arms 3 will be displaced in positions far away from the center axis of the voice coil bobbin. Therefore, when the voice coil bobbin has an outer diameter which is equal to that of a conventional speaker unit, even if the flexibly movable supporting arms 3 on both sides of the shorter axis 5 are in inverse resonance conditions, a possible inclining angle in which the voice coil bobbin inclines will become small.

Further, each pair of flexibly movable supporting arms 3, 3 symmetrically arranged on both sides of the longer axis 4, together hold a reinforcing member 6, thus forming a frame structure including the flexibly movable supporting arms 3, the reinforcing member 6, the inner frame 1, effectively preventing a deformation possibly caused by a torsion. In this way, not only is it sure that the flexibly movable supporting arms 3 can obtain necessary and sufficient compliance, but also ensure that the voice coil bobbin may be prevented from a trouble called inverse resonance.

Therefore, while the flexibly movable supporting arms 3 can obtain necessary and sufficient compliance, the voice coil bobbin and the vibrating diaphragm may be prevented from rolling when the speaker unit is in operation, thus ensuring an improved stability for the speaker unit.

In the present embodiment, the speaker damper shown in FIG. 1 is integrally formed using only one kind of resin, but it is also possible that the damper may be made of a composite material. Also, in the present embodiment, although the reinforcing members 6 are formed integrally with the damper main body, they may also be made of a metal having a predetermined precision in size, and may be bridged over the flexibly movable supporting arms 3. In addition, the damper shown in FIG. 1 may also be formed by punching a resin plate or a metal plate.

Further, it is also possible that the reinforcing member 6 may be formed as integral portions of the inner frame 1. Finally, if the mass of the reinforcing member 6 does not bring any influence to the characteristic of the speaker unit, it is also allowed that there is no gap between each reinforcing member 6 and the inner frame 1.

While the preferred embodiments of this invention have been shown and described above, it is to be understood that these disclosures are for the purpose of illustration and that various changes and modifications may be made without departing from the scope of the invention as set forth in the appended claims.

What is claimed is:

1. A speaker damper comprising:

an inner frame for receiving and holding a voice coil bobbin;

an outer frame configured to be fixed on to a speaker frame in a speaker unit;

a plurality of flexibly movable supporting arms bridged across a space between the inner frame and the outer frame;

a plurality of reinforcing members each bridged across a space between at least two of the flexibly movable supporting arms at a position adjacent to the inner frame.

2. The speaker damper according to claim 1, wherein each of the reinforcing members is bridged across the space between two flexibly movable supporting arms, adjacent to the inner frame, so as to cooperate with the flexibly movable supporting arms to reinforce the inner frame.

3. The speaker damper according to claim 1, wherein the outer frame, the plurality of flexibly movable supporting arms, the inner frame, the reinforcing members are integrally formed with each other by means of injection molding.

4. The speaker damper according to claim 1, wherein the inner frame is in a circular form, whereas the outer frame is in an elliptical form.

5. The speaker damper according to claim 1, wherein the reinforcing members may be made of a metal.

6. The speaker damper according to claim 1, wherein the reinforcing members are formed adjacent to the inner frame such that there is no gap between the reinforcing members and the inner frame.

7. A speaker damper comprising:

an inner frame for receiving and holding a voice coil bobbin;

an outer frame configured to be fixed on to a speaker frame in a speaker unit;

a plurality of flexibly movable supporting arms bridged across a space between the inner frame and the outer frame; and a plurality of reinforcing members each bridged across a space between at least two of the flexibly movable supporting arms at a position adjacent to the inner frame, each flexibly movable supporting arm including one portion connecting with one of the reinforcing members and another portion connecting with the outer frame to ensure compliance of the speaker damper.

8. A speaker damper comprising:

an inner frame for receiving and holding a voice coil bobbin;

an outer frame configured to be fixed on to a speaker frame in a speaker unit;

a plurality of flexibly movable supporting arms bridged across a space between the inner frame and the outer frame, at least two pairs of the flexibly movable supporting arms being arranged symmetrically on both sides of an axis extending along a length of the speaker damper; and a plurality of reinforcing members each bridged across a space between two flexibly movable supporting arms at a position adjacent to the inner frame, each pair of flexibly movable supporting arms holding at least one of the reinforcing members;

wherein the flexibly movable supporting arms, the at least one reinforcing members held by the pairs of flexibly movable supporting arms, and the inner frame form a frame structure, for reducing deformation caused by applied torsion.

9. A speaker damper according to claim 8, wherein each pair of flexibly movable supporting arms arranged symmetrically on both sides of the axis is integrally connected through geometrically symmetrical positions of the arms of that pair with a corresponding one of reinforcing members.

10. A speaker damper according to claim 8, wherein each reinforcing member extends in a direction substantially orthogonal to a flexible direction of the flexibly movable supporting arms.

* * * * *